United States Patent [19]

Inaba et al.

[11] Patent Number: 4,925,402

[45] Date of Patent: May 15, 1990

[54] CONNECTOR WITH FITTING CONFIRMATION DEVICE

[75] Inventors: Shigemitsu Inaba; Kazuto Ootaka; Shigemi Hashizawa, all of Shizuoka, Japan

[73] Assignee: Yazaki Corporation, Japan

[21] Appl. No.: 260,685

[22] Filed: Oct. 21, 1988

[30] Foreign Application Priority Data

Oct. 22, 1987 [JP] Japan ..... 62-265338

[51] Int. Cl.[5] ..... H01R 3/00

[52] U.S. Cl. ..... 439/490; 439/491

[58] Field of Search ..... 439/374, 488–491, 439/677, 680, 133, 681; 29/868, 869

[56] References Cited

U.S. PATENT DOCUMENTS 3,611,261 10/1971 Gregory ..... 439/680 X 4,721,475 1/1988 Burke ..... 439/133 X

FOREIGN PATENT DOCUMENTS 53-95187 3/1978 Japan .

581191 10/1946 United Kingdom ..... 439/680

OTHER PUBLICATIONS

IBM Technical Disclosure Bulletin, M. C. Panaro, "Clicking Connector", vol. 1 No. 4, Dec. 1958.

*Primary Examiner*—Eugene F. Desmond

*Attorney, Agent, or Firm*—Wigman & Cohen

[57] ABSTRACT

Disclosed herein is a connector which comprises a female housing, a male housing to be inserted and fitted into the female housing, first guide member having first confirmation apertures, the first guide member being provided on the female housing, and second guide member having second confirmation apertures, the second guide member being provided on the male housing such that the second guide member is cooperatively guided by the first guide member and such that the first confirmation apertures aligns with the second confirmation apertures at least at a point during the insertion of the male housing into the female housing, whereby the fitting condition between the female and male housings can be detected by detecting the relative positions of the first and second apertures. In order to detect the relative positions, an opto-electronics detector can be used. Then, the amount of the detected light is converted into electrical signal which inputted into a computer, whereby automatic detection of the fitting condition of the housings can be attained.

11 Claims, 4 Drawing Sheets

FIG. 4(A)
FIG. 4(B)
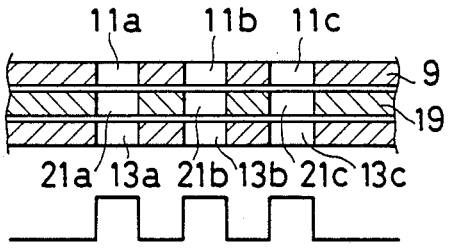
FIG. 5(A)
FIG. 5(B)
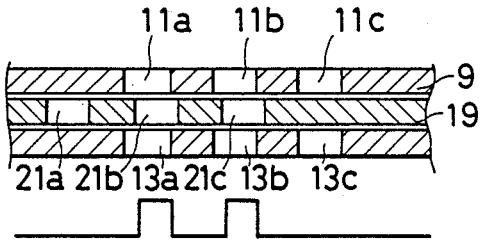
FIG. 6(A)
FIG. 6(B)
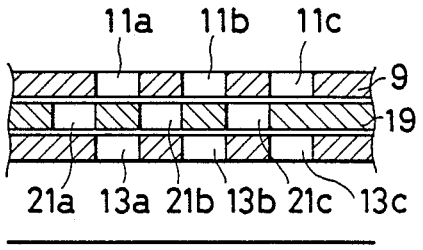

CONNECTOR WITH FITTING CONFIRMATION DEVICE

BACKGROUND OF THE INVENTION

1. Field of the Invention

This invention relates to a connector, and in particular to a connector comprising a female connector having a female housing and a male connector having a male housing to be fitted to the female connector housing, in which the connector has a fitting detection device for confirming whether a proper fitting of these connector housings has been made.

2. Description of the Prior Art

Conventionally, a connector having such a device is disclosed in Japanese Laid Open Utility Model Publication No. 53-95187. This connector comprises a male housing and a female housing to be fitted to the male housing. Further, the connector has a fitting detection device which comprises an light-emitting element, a detection element and a reflecting plate on which light emitted from the light-emitting element through a first optical pass is reflected toward the detection element through a second optical pass. These first and second opto-electronic passes are formed at an incline in the female housing and the reflecting plate is provided on the fitting surface of the male housing which faces the optical passes. Further, this connector further comprises a opto-electronic converter element which enables to convert the reflected light at the detection element to an electrical signal.

However, in the conventional connector having the fitting detection device, there are problems in that it is necessary to provide a reflecting plate and optical passes as well as a light-emitting element and a detection element, which thus makes the size of the device large and the structure thereof quite complicated. In addition, as a result of the complicated structure of this device, the process for confirming a proper fitting of the housings is very troublesome.

Furthermore, since the conventional connector has two inclined optical passes formed in the female housing, it is difficult to form the housing, thus leading to increased manufacturing costs.

Moreover, with the fitting detection device of the conventional connector, it was not possible to determine the fitting degree of the housings and it was impossible to determine any other information such as the type of connector being used.

SUMMARY OF THE INVENTION

In view of the foregoing disadvantages of the conventional connector, the present invention has been made. Accordingly, a main object of the present invention is to provide a connector which can easily confirm with a device having a simple structure whether a perfect fitting has been made between the male and female housings when they are fitted together.

Another object of the present invention is to provide a connector which can confirm the imperfect fitting degree between the male and female housings.

Yet another object of the present invention is to provide a connector with an identification means for enabling a detector to determine the specific type or class of the connector.

Yet another object of the present invention is to reduce the manufacturing cost of the connector having the above features.

In order to accomplish the objects, the connector of the present invention comprises a female housing, a male housing to be inserted and fitted into the female housing, first guide means having first confirmation means, the first guide means being provided on the female housing, and second guide means having second confirmation means, the second guide means being provided on the male housing such that the second guide means is cooperatively guided by the first guide means and such that the first confirmation means aligns with the second confirmation means at least at a point during the insertion of the male housing into the female housing, whereby the fitting condition between the female and male housings can be detected by detecting the relative positions of the first and second confirmation means.

According to the connector having the above structure, the perfect fitting condition between the female and male housings are easily confirmed by detecting the relative positions of the first and second means.

Further, by detecting the degree of the dislocation of the relative positions of the first and second means, it is also possible to know the imperfect fitting degree of these housings. In these cases, if a detector such as a opto-electronics detecting device is used to detect the relative positions and a computer which outputs the detected information, these perfect or imperfect fitting condition is automatically detected.

Furthermore, if the confirmation means includes the identification means such as an aperture having a specific size or shape according to the type or class of the connector is provided, it will be possible to detect the type and size from the detected information.

BRIEF DESCRIPTION OF THE DRAWINGS

The objects and advantages of the present invention, as well as the details of the preferred embodiments, will be more fully understood when taken in conjunction with the following drawings, in which:

FIGS. 4(A)(B), 5(A)(B) and 6(A)(B) show the relationship between the positions of each confirmation apertures and the amount of the penetrated light through an optical pass formed by the apertures.

DETAILED DESCRIPTION OF THE PREFERRED EMBODIMENTS

Figure 1:
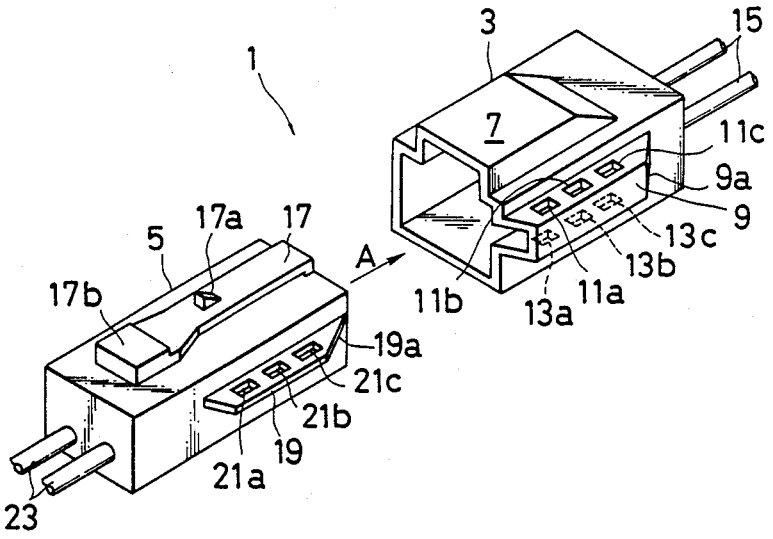
FIG. 1 shows a disassembled perspective view of a first embodiment of the connector of the present invention.

Referring now to the drawings, the preferred embodiments of the present invention will be described.

In FIG. 1, a connector 1 comprises a female housing 3 and male housing 5 fittable to the female housing 3, both having a box-like shape. On the upper surface of the female housing 3, a locking portion 7 to be fitted to a partner member of the male connector housing 5 is provided, in which a locking aperture (not shown) is formed.

On one of the surfaces of the female housing 3, preferably on one of the lateral surfaces of the female housing 3, a guide channel 9 having a substantially C-shaped cross section is provided in a protruding manner along the fitting direction of the housings 3 and 5. At the tip portion of the guide channel 9, an inclined receiving end surface 9*a* is formed.

On the corresponding positions of each of the upper and lower surfaces of the guide channel 9, there are provided three confirmation apertures 11*a*, 11*b*, 11*c* and 13*a*, 13*b*, 13*c*, respectively. It is preferred that the confirmation apertures have a substantially rectangular shape and be equal in size.

Inside the female housing 3, terminals (not shown) connected to ends of wires 15, respectively, are accommodated. In this embodiment, two terminals connected to the two wires 15 are accommodated.

On the other hand, on the upper surface of the male housing 5, a locking portion 17 is provided. The locking portion 17 has a plate-like shape extending in the longitudinal direction of the housing 5, which is flexibly supported at one end thereof to the tip side of the upper surface of the male housing 5. On the locking portion 17, there are formed a locking projection 17*a* to be engaged with the locking aperture of the locking portion 7 of the female housing 3 and an abutment part 17*b* which abuts the entrance portion of the locking portion 7.

On the lateral surface of the male housing 5, which corresponds to the lateral surface of the female housing 3 on which the guide channel 9 is provided, a guide member 19 which also extends along the fitting direction of the housing 3 and 5 is protrudingly provided to be slidably fitted into the guide channel 9 of the female housing 3. The guide member 19 comprises a plate like member, and on the tip portion thereof there is also formed a inclined abutting portion 19*a* to be abutted on the inclined receiving end surface 9*a* of the female housing 3. This makes it easy to withdraw the guide member 19 from the guide channel 19.

On the guide member 19, there are formed three apertures 21*a*, 21*b* and 21*c*. The positions where these apertures are formed on the guide member 19 correspond to the positions of the confirmation apertures 11*a*, 11*b*, 11*c* and 13*a*, 13*b*, 13*c*. Further, the size and shape of the apertures are the same as those of the guide channel 9 of the female housing 3. Namely, the apertures 21*a*, 21*b* and 21*c* of the guide member 19 are formed so that these apertures become aligned with the confirmation apertures 11*a*, 11*b*, 11*c* and 13*a*, 13*b*, 13*c* of the guide channel 9 of the female housing 3 when the female housing 3 and male housing 5 are properly fitted to each other. In this case, it is preferred that the abutting portion 19*a* of the guide member 19 be abutted on the inclined receiving end surface 9*a* of the guide channel 9 when the female and male housings are properly fitted together.

Inside the male housing 5 there are accommodated two terminals (not shown) connected to two wires 23, respectively. These terminals are fittable to the terminals in the female housing 3 when the female and male housings 3 and 5 are fitted to each other.

Figure 2:
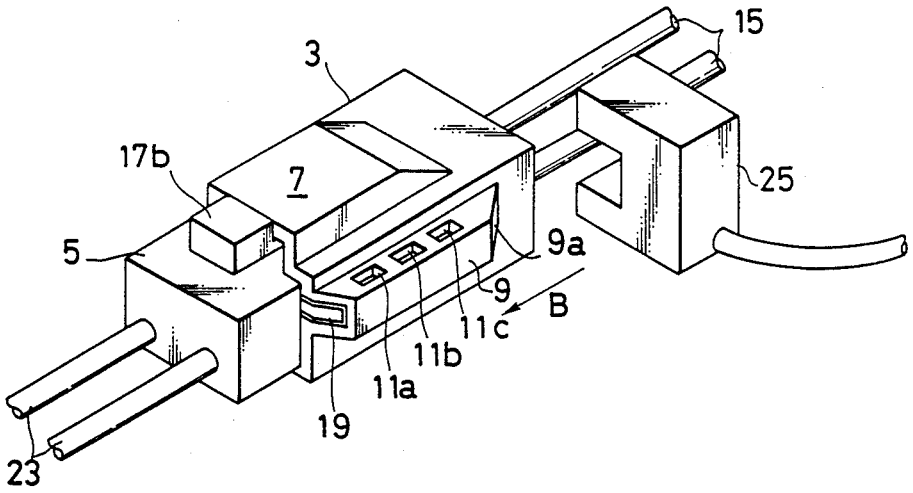
FIG. 2 shows a perspective view of the connector and a luminous detector.

When the male and female housings 3 and 5 are to be fitted to each other, the male housing 5 is inserted into the female 3 along the direction indicated by the arrow A in FIG. 1. Once the male and female housings 3 and 5 are fitted to each other, the locking portion 17 of the male 5 engages with the locking portion 7 of the female housing 3 by the engagement of the locking projection 17*a* and the locking aperture (not shown) and the abutment of the abutment part 17*b* against the entrance portion of the locking portion 7, as shown in FIG. 2. In this condition, the guide member 19 of the male housing 5 is slidably inserted into the guide channel 9 of the female housing 3 as the two housings 3 and 5 are fitted together.

With the above structure, proper fitting of the housings 3 and 5 can be confirmed simply by confirming the fitting condition between the guide member 19 and the guide channel 9. Namely, as stated above, the confirmation apertures of the guide channel 9 and the guide member 19 are formed so as to be precisely aligned with each other when the female and male housings 3 and 5 are properly fitted together. Therefore, by detecting the locational relationship between the confirmation apertures 11*a*, 11*b*, 11*c* and 13*a*, 13*b*, 13*c* and the confirmation apertures 21*a*, 21*b*, 21*c*, it is possible to confirm the fitting condition between the male and female housings 3 and 5.

Figure 3:
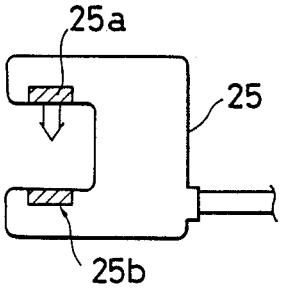
FIG. 3 shows a front view of the luminous detector.

In order to detect the fitting condition between the housings 3 and 5, a C-shaped optical detector 25, as shown in FIGS. 2 and 3, is used. The optical detector 25 comprises a light-emitting element 25*a* and a detection element 25*b*, and light emitted from the light-emitting element 25*a* is received by the detection element 25*b*. Detection is carried out by moving the C-shaped optical detector 25 along the arrow B in FIG. 2 and passed along the guide channel 9 into which the guide member 19 is inserted. The light emitting element 25*a* and the detection element 25*b* pass along the upper and lower sides of the guide member 9, respectively, and light emitted from the light-emitting element 25*a* passes through optical passes formed by the relative positions of the apertures 11*a*, 11*b*, 11*c* and 13*a*, 13*b*, 13*c* and the apertures 21*a*, 21*b* and 21*c*, and is then detected by the detection element 25*b*. In this regard, please note that the optical passes may be completely closed or very narrow, depending on the relative positions of the apertures. As a result, the amount of light received by the detection element 25*b* depends upon the fitting condition between the housings 3 and 5. The amount of light detected is converted to an electrical signal by an optoelectronic converter in the detection device 25, and then the electrical signal is sent to a computer (not shown), whereby the fitting condition is determined.

In FIGS. 4, 5 and 6, some examples of operation processes for this device are shown.

FIG. 4 (A) shows the condition in which the female housing 3 and the male housing 5 are properly fitted together. In this condition, the confirmation apertures 11*a*, 11*b*, 11*c* and 13*a*, 13*b*, 13*c* of the guide channel 9 of the female housing 3 and the confirmation apertures 21*a*, 22*b* and 22*c* of the male housing 5 are precisely aligned with each other, respectively, to form three optical passes therebetween. As shown in FIG. 4(B), the rectangular wave detected by the detector 25 has three rectangular peaks each having an identical shape. From a determination of the width of these peaks, it is possible to confirm a perfect fitting condition between the female and male housings 3 and 5.

FIG. 5(A) shows a different case in which the female and male housings 3 and 5 are imperfectly fitted to each other In this condition, only two confirmation apertures 21*b* and 21*c* of the guide member 19 are in a partially aligned position with the confirmation apertures 11*a*, 11*b* and 13*a*, 13*b*, so that only two optical passes are created. In addition, these optical passes have relatively smaller widths than those for the condition in FIG.

4(A). Therefore, as shown in FIG. 5(B), the rectangular wave detected at the detector 25 has only two rectangular peaks, and each of these peaks has a width that is narrower than the width of one of the rectangular peaks in FIG. 4(B).

FIG. 6(A) shows another condition in which the female and male housings 3 and 5 are imperfectly fitted together. In this condition, confirmation apertures 21*a*, 21*b* and 21*c* of the guide member 19 are completely out of alignment with the confirmation apertures 11*a*, 11*b*, 11*c* and 13*a*, 13*b*, 13*c* of the guide channel 9, and therefore no optical passes are created through the guide channel 9. Thus, the wave from the detector 25 does not have any rectangular peaks. As a result, it is possible to realize that the female and male housing are imperfectly fitted, and that the imperfect fitting condition is different from that of the condition in FIG. 5(A).

In this embodiment, the upper and lower surfaces of the guide channel 9 and the guide member 19 have three confirmation apertures 11*a*, 11*b*, 11*c* and 13*a*, 13*b*, 13*c* and apertures 21*a*, 21*b*, 21*c*, respectively. Namely, three layered structures each having three confirmation apertures are used. However, according to the information to be obtained, it is possible to increase or decrease the number of confirmation apertures and the number of layers.

In this respect, please note that if the number of apertures are increased, it is possible to obtain more precise information concerning the fitting condition between the housings 3 and 5. Further, by changing the shape of the confirmation apertures and the spacings between the apertures, the rectangular shapes obtained in the rectangular wave can be varied. Therefore, if the shape of the apertures and the spacings between the apertures are chosen to suite specific types of connectors, and if the number and size of the specific rectangular shapes and the width of the spacing for these types of connectors are inputted in advance into a computer, it becomes possible to detect not only the fitting condition between housings of the connector but also the type of the connector, and possibly other information such as the manufacturing number or the like.

Figure 7:
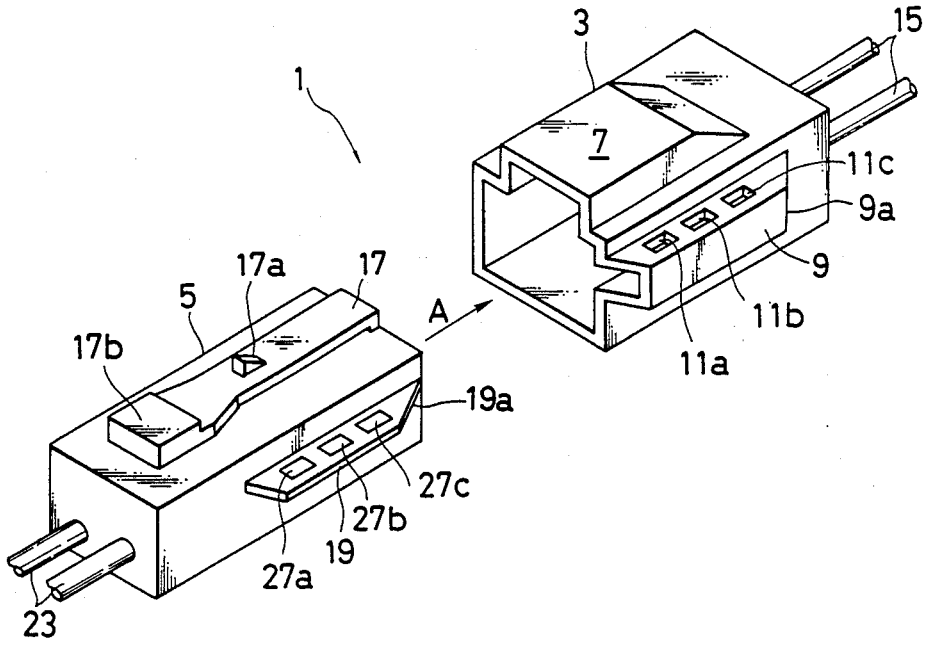
FIG. 7 shows a second embodiment of the connector of the present invention.

FIG. 7 shows a second embodiment of the present invention. In this embodiment, reflecting members 27*a*, 27*b*, 27*c*, which enable reflect light emitted from the light-emitting element 25*a*, are provided on the guide member 19, instead of the confirmation apertures 21*a*, 21*b* and 21*c* of the first embodiment. In this case, it is preferable that different color paints having different reflectances, such as red, blue, white or the like, be applied to the reflecting members, respectively. Further, it may also be possible to use different materials having different reflectances for the reflecting members. For this embodiment, it is not necessary to provide confirmation apertures 13*a*, 13*b* and 13*c* on the lower surface of the guide channel 9 in FIG. 1. Furthermore, a plate-like member similar to the guide member 19 can be used instead of the guide channel 9, and a reflection-type detector which has a light-emitting element and a detection element on the same side thereof is used instead of a detector such as the C-shaped detector of the first embodiment.

The structural features and functional effects of this embodiment other than those described above are substantially the same as for the first embodiment previously described, and any detailed description of them is believed to be unnecessary.

In these embodiments the relative positions of the confirmation apertures is detected by a detector and a computer. However, it should be noted that it may, of course, be possible to determine the relative positions of the apertures by macrography.

Finally, it must be understood that the invention is in no way limited to the above embodiments and that many changes may be brought about therein without departing from the true scope of the invention as defined by the appended claims.

We claim:

1. A connector comprising:

a female housing;

a male housing to be inserted and fitted into the female housing;

first guide means provided on the female housing, the first guide means including first confirmation means comprised of at least one first aperture formed on the first guide means; and second guide means provided on the male housing to act cooperatively with the first guide means during the insertion of the male housing into the female housing, the second guide means including second confirmation means, the second confirmation means having at least one second aperture formed on the second guide means, whereby the fitting state of the female and male housings can be detected by detecting the relative positions of the first and second apertures;

wherein said first and second apertures have the same size and shape, respectively;

wherein said at least one first aperture of said first guide means and said at least one second aperture of said second guide means are provided such that said first and second apertures are precisely aligned when said male and female housings are properly fitted to each other; and wherein said female and male housings having a side surface, respectively, and said first guide means comprise a guide channel member provided on the side surface of said female housing and said second guide means comprises a plate-like guide member provided on the side surface of said male housing slidably inserted into said guide channel member when said female and male housings are fitted to each other.

2. A connector as claimed in claim 1, wherein said guide channel member has an upper and a lower surface, respectively, and said at least one first aperture comprises apertures formed on said upper and lower surfaces of said guide channel member, and said at least one second aperture comprises apertures formed on said guide member.

3. A connector, comprising:

a female housing;

a male housing to be inserted and fitted into the female housing;

first guide means provided on the female housing, the first guide means including first confirmation means; and second guide means provided on the male housing to act cooperatively with the first guide means during the insertion of the male housing into the female housing, the second guide means including second confirmation means, whereby the fitting condition between the female and male housings can be detected by detecting the relative positions of the first and second confirmation means;

wherein the connector is furnished with a detector for detecting the relative positions between the first and second confirmation means.

4. A connector as claimed in claim 3, wherein said detector comprises a opto-electronics detecting device.

5. A connector as claimed in claim 4, wherein said first confirmation means comprises at least one first aperture formed on the first guide means and said second confirmation means comprises at least one second aperture formed on the second guide means, and said opto-electronics detecting device comprises a substantially C-shaped detecting device having a light emitting element and a light detecting element, and said C-shaped detecting device is provided such that a light emitted from the light emitting element passes through said first and second apertures to reach said light detecting element when both apertures are aligned.

6. A connector as claimed in claim 5, wherein the number of said first and second apertures and the space between said apertures are changed according to a type of the connector, whereby enabling to distinguish the type of the connector by the information obtained by said detector.

7. A connector as claimed in claim 4, wherein said first confirmation means comprises at least one aperture formed on said first guide means, and said second confirmation means comprises at least one reflecting member on which light from said opto-electronics detecting device is reflected.

8. A connector as claimed in claim 7, wherein different color paints having different reflectances are applied to the reflecting members, respectively.

9. A connector, comprising:

a female housing;

a male housing to be inserted and fitted into the female housing;

first guide means provided on the female housing, the first guide means including first confirmation means comprised of at least one first aperture formed on the first guide means; and second guide means provided on the male housing to act cooperatively with the first guide means during the insertion of the male housing into the female housing, the second guide means including second confirmation means, the second confirmation means having at least one second aperture formed on the second guide means, whereby the fitting state of the female and male housings can be detected by detecting the relative positions of the first and second apertures;

wherein said first and second apertures have the same size and shape, respectively;

wherein said at least one first aperture of said first guide means and said at least one second aperture of said second guide means are provided such that said first and second apertures are precisely aligned when said male and female housings are properly fitted to each other; and wherein the connector is furnished with a detector for detecting the relative positions between the first and second confirmation means.

10. A connector as claimed in claim 9, wherein the detector comprises an opto-electronics detecting device.

11. A connector as claimed in claim 10, wherein said opto-electronics detecting device comprises a substantially C-shaped detecting device having a light emitting element and a light detecting element, and said C-shaped detecting device is provided such that a light emitted from the light emitting element passes through said first and second apertures to reach said light detecting element when both apertures are aligned.

* * * * *